US005498320A

United States Patent [19]

Rendall

[11] Patent Number: 5,498,320

[45] Date of Patent: Mar. 12, 1996

[54] METHOD AND APPARATUS FOR ELECTROLYTIC REDUCTION OF FINE-PARTICLE ALUMINA WITH POROUS-CATHODE CELLS

[75] Inventor: John S. Rendall, Albuquerque, N.M.

[73] Assignee: Solv-Ex Corporation, Albuquerque, N.M.

[21] Appl. No.: 356,149

[22] Filed: Dec. 15, 1994

[51] Int. Cl.[6] ..... C25C 3/06; C25C 3/14; C25C 3/08

[52] U.S. Cl. ..... 205/385; 204/245; 204/284

[58] Field of Search ..... 204/245, 67, 243 R–244, 204/246–247, 284, 241

[56] References Cited

U.S. PATENT DOCUMENTS

| | | | |
|---|---|---|---|
| 4,462,886 | 7/1984 | Kugler | 204/284 |
| 4,544,457 | 10/1985 | Sane et al. | 204/284 X |
| 4,551,218 | 11/1985 | Gesing et al. | 204/245 X |
| 4,592,812 | 6/1986 | Beck et al. | 204/67 |
| 4,681,671 | 7/1987 | Duruz | 204/245 X |
| 4,865,701 | 9/1989 | Beck et al. | 204/67 |
| 5,006,209 | 4/1991 | Beck et al. | 204/67 |
| 5,284,562 | 2/1994 | Beck et al. | 204/243 R |

OTHER PUBLICATIONS

T. R. Beck, "Production of Aluminum with Low Temperature Fluoride Melts", Proc. TMS Light Metals, 123rd Mtg. SFO 2–27/3–3–94, pp. 417–423, ©1994.

*Primary Examiner*—Donald R. Valentine

*Attorney, Agent, or Firm*—Thomas E. Schatzel

[57] ABSTRACT

In aluminum smelting by electrolysis, a double salt of $KAlSO_4$, as a feedstock, is heated with a eutectic electrolyte, such as $K_2SO_4$, at 800° C. for twenty minutes to produce an out-gas of $SO_3$ and a liquid electrolyte of $K_2SO_4$ with fine-particles of $Al_2O_3$ in suspension having a mean size of six to eight microns. This is pumped into a cell with an electrolyte comprised of $K_2SO_4$ with fine-particles of $Al_2O_3$ in suspension, an anode and a porous cathode of open-cell ceramic foam material. The cell is maintained at 750° C. and four volts of electricity applied between the anode and the cathode causes oxygen to bubble at the anode and liquid aluminum to form in the porous cathode. A channel within the porous cathode, and the porous cathode itself, are deep enough within the cell electrolyte that the pressure head of electrolyte is enough to overcome the difference in density between the molten aluminum and the electrolyte to pump molten aluminum from the channel out of the side of the cell. The electrolyte $K_2SO_4$ is periodically bled-off to control a build-up of the material as aluminum is produced from the double salt of $KAlSO_4$.

15 Claims, 3 Drawing Sheets

METHOD AND APPARATUS FOR ELECTROLYTIC REDUCTION OF FINE-PARTICLE ALUMINA WITH POROUS-CATHODE CELLS

RELATED APPLICATIONS

A copending application for United States Patent, filed Sep. 2, 1994, Ser. No. 08/300,441, is incorporated herein by reference.

BACKGROUND OF THE INVENTION

1. Field of the Invention

The invention relates generally to metal ore refining and specifically to the electrolytic reduction of alumina, aluminum sulfates and potassium aluminum sulphate into aluminum metal.

2. Description of the Prior Art

Vast deposits of oil exist throughout the world, and especially in Canada, as thick, heavy oil, in the form of bitumen mixed with solid minerals and water. The tar sands that hold the bitumen contain rich amounts of valuable minerals, especially alumina, as clay in the sand itself. The sands include a fines fraction, defined as particles less than forty-four microns, that have a clay component (0–20 microns) and a silica fine sand component (20–44 microns). High bitumen content in the tar sand is usually associated with a low clay content. Conversely, a low bitumen content in the tar sand is usually associated with a high clay content. This is because it is the sand, and not the clay, that embraces the bitumen.

Typically there are found two parts silica fine sand component to one part clay component, e.g., one-third is clay. About 35% of such clay is alumina. Certain low grade ores, conventionally comprised of undifferentiated silica fine sand and clay, have as little as 6% alumina. Such low-grade ores are a problem when used in exothermic reactions that separate out the alumina. High-grade ores, with more than 10% alumina, are much more easily processed exothermically.

The principle commercial method used for the electrolytic reduction of alumina to aluminum is the Hall-Heroult process. This traditional process uses a molten bath of sodium cryolite ($Na_3AlF_6$) that is contained in a cell lined with carbon. A pool of molten aluminum lies at the bottom of the cell and serves as the cell's cathode. Consumable carbon anodes are dipped down into the electrolyte bath. Alumina is introduced to the bath which dissolves the alumina and aluminum reduction occurs in the form of liquid aluminum droplets. Typical operating temperatures are 950° C. (1,742° F.) to 1,000° C. (1,832° F.). Carbon dioxide is released, from a reaction of the oxygen electrically-forced from the alumina with the carbon in the anodes. As such, the carbon anodes are consumed and must be periodically adjusted and/or replaced. Large amounts of electricity are also required, which makes aluminum recycling a competitive source of aluminum metal.

On Jun. 3, 1986, U.S. Pat. No. 4,592,812, was issued to Theodore R. Beck, et al., which describes the electrolytic reduction of alumina. A cell used in the reduction has an electrolyte bath of halide salts. A non-consumable anode is positioned at the bottom of the bath, and a dimensionally-stable cathode coated with titanium diboride is spaced above in the bath. Particles of alumina are introduced to the bath and form ions of aluminum and oxygen. The oxygen ions are converted to gaseous oxygen at the anode when electricity is applied. The gaseous oxygen bubbles at the anode and agitates the bath. The aluminum ions are converted to metallic aluminum at the cathode. The cell temperature is just high enough to keep the metallic aluminum molten, and the liquid aluminum accumulates as a pool on top of sludge at the bottom the bath and the secondary cathode.

Theodore R. Beck, et al., were issued U.S. Pat. No. 4,865,701, on Sep. 12, 1989, which describes another electrolytic cell with a bath of halide salts. The anodes and cathodes are vertical plates that are interdigitated and dipped from above into the bath. Bubbling of oxygen at the anodes agitates the bath and resists the settling of alumina particles at the bottom of the bath. Molten aluminum droplets form at the cathodes and flow down to accumulate at the bottom of the bath in a sump.

The use of finely-divided alumina particles in the electrolytic reduction of alumina to aluminum is described by Theodore R. Beck, et al., in U.S. Pat. No. 5,006,209, issued Apr. 9, 1991. Alternating, vertically-disposed cathodes and anodes are used with a horizontally-disposed gas-bubble generator in a molten electrolyte bath of balanced amounts of $NaF+AlF_3$ eutectic, $KF+AlF_3$ eutectic and LiF. The gas-bubble generator keeps the alumina particles in suspension. The bath eutectics allow the cell to be operated at a substantially lower temperature, e.g., 660° C. (1220° F.) to 800° C. (1472° F.). The cathodes are made of titanium diboride ($TiB_2$), a refractory hard metal. The anodes are composed of nickel-iron-copper (Ni-Fe-Cu) cermet. The mean size of the alumina particles introduced to the bath ranges between one micron and one hundred microns, preferably within a range of two to ten microns. The smaller alumina particle sizes are described as being easier to maintain in suspension. But such fine particles are said to have a tendency to agglomerate into clumps which settle out of the bath rapidly. So bottom-located gas generators in the bath are included to deal with this problem.

Theodore R. Beck, et al., describe a non-consumable anode and lining for an aluminum electrolytic reduction cell in U.S. Pat. No. 5,284,562, issued Feb. 8, 1994. The electrolyte used has a eutectic of $AlF_3$ and either NaF, or primarily NaF with KF and LiF. The anodes used are made of copper, nickel and iron.

A cell for the "production of aluminum with low-temperature fluoride melts" is described, by Theodore R. Beck, in *Proceedings of the NS Light Metals Committee,* from the 123rd TMS Annual Meeting in San Francisco, Calif., Feb. 27, 1994 to Mar. 3, 1994, pp. 417–423, as published by The Minerals, Metals & Materials Society (TMS) 1994. The proposed commercial cell design uses a eutectic electrolyte with a freezing point below 695° C. of either NaF with $AlF_3$ or a mixture of $NaF/AlF_3$, $KF/AlF_3$ and $LiF/AlF_3$, eutectics operating about 750° C. A 5–10% slurry, by weight, of $Al_2O_3$ with a particle size less than ten microns is required. Close-spaced vertical monopolar anodes and $TiB_2$ cathodes are used, which makes a potroom to house a potline of such cells dramatically reduced in size over the conventional horizontal-cell potrooms. A horizontal bottom auxiliary anode is used in the cell to agitate the electrolyte to keep sludge from forming from alumina that falls out of suspension, as occurs when the alumina particles agglomerate or are individually larger than ten microns. A device to continuously transport out aluminum produced by the cell is identified as a necessity, but no suitable mechanism is described. Also, feedstocks of alumina with particle sizes less than forty-four microns are generally not available, e.g., because of the severe dust problem such powders can produce. Alumina is injected into the bath from above and contributes to a dust problem due to oxygen capturing alumina dust as it leaves the molten electrolyte surface. In addition, it is difficult in the envisaged tall cells to insure that the alumina reaches all the areas of electrolysis. This and the separation of the aluminum from the bottom sludge are problems for the commercial operation with unspecified solutions. Therefore, the description here by Beck of a practical commercial cell is incomplete.

SUMMARY OF THE PRESENT INVENTION

It is therefore an object of the present invention to provide a process for smelting aluminum.

It is a further object of the present invention to provide a cell for smelting aluminum with a porous cathode.

It is another object of the present invention to provide a cell for smelting aluminum that operates at approximately 660° C.

It is a further object of the present invention to provide a cell for smelting aluminum that uses as little as nine kilowatt hours of electricity for every kilogram of aluminum metal produced from alumina ore.

It is another object of the present invention to provide a practical method of producing an alumina feedstock for the electrolysis of aluminum in a cell that has alumina particles no bigger than ten microns.

Briefly, in a preferred method embodiment of the present invention, a double salt of $KAlSO_4$, as a feedstock, is heated with a eutectic electrolyte, such as $K_2SO_4$, at 800° C. for twenty minutes to produce an out-gas of $SO_3$ and a liquid electrolyte of $K_2SO_4$ with fine-particles of $Al_2O_3$ in suspension having a mean size of six to eight microns. This is pumped into a cell with an electrolyte comprised of $K_2SO_4$ with fine-particles of $Al_2O_3$ in suspension, an anode and a porous cathode of open-cell ceramic foam material. The cell is maintained at 750° C. and four volts of electricity applied between the anode and the cathode causes oxygen to bubble at the anode and liquid aluminum to form in the porous cathode. A channel within the porous cathode and the porous cathode itself are deep enough within the cell electrolyte that the pressure head of electrolyte is enough to overcome the difference in density between the molten aluminum and the electrolyte. Molten aluminum flows from the channel out the side of the cell.

An advantage of the present invention is that a system is provided for smelting aluminum that reduces the cost of operation.

A further advantage of the present invention is that a system is provided for smelting aluminum that generates oxygen and not carbon dioxide at its cell anodes.

Another advantage of the present invention is that a method is provided for producing fine particles of $Al_2O_3$ in an electrolyte suspension having a mean size of six to eight microns.

These and other objects and advantages of the present invention will no doubt become obvious to those of ordinary skill in the art after having read the following detailed description of the preferred embodiments that are illustrated in the various drawing figures.

IN THE DRAWINGS

DETAILED DESCRIPTION OF THE PREFERRED EMBODIMENTS

Figure 1:
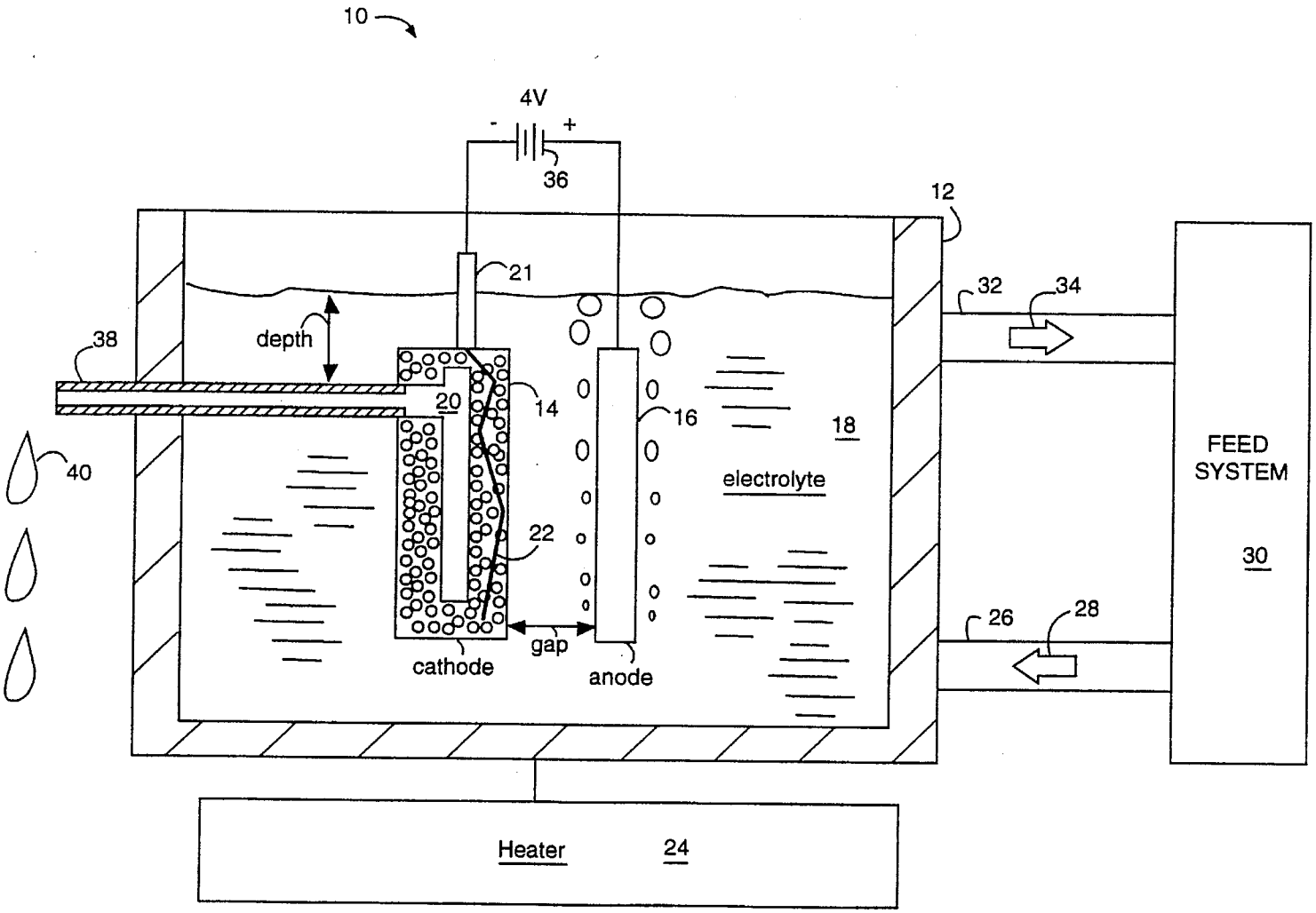
FIG. 1 is a diagram of a system for smelting aluminum by electrolysis in a first embodiment of the present invention.

FIG. 1 illustrates a system for smelting aluminum in a first embodiment of the present invention referred to,herein by the general reference number 10. The system 10 comprises a pot cell vessel 12, a porous cathode 14, an anode 16 and an electrolyte 18. A gas comprised of $O_2$ bubbles off the anode 16. A fine alumina ($Al_2O_3$) is included in the electrolyte 18 for an electrolytic reduction to aluminum. The porous cathode 14 is comprised of an open-cell porous non-conductive foam material and has a channel 20 for conducting liquid aluminum. A sleeve insulator 21 insulates a connection to a wire 22 which is threaded in the foam material or the channel 20 and provides for electrically-contacting the liquid aluminum to function as a cathode electrode.

A heater 24 maintains an operating temperature above the melting point of aluminum (660° C.), e.g., in the range of 700° C. to 800° C., depending on the composition of the electrolyte 18.

In one embodiment, an input 26 supplies a fine-particle alumina ($Al_2O_3$) and potassium sulphate ($K_2SO_4$) electrolyte in a mixture 28 to the electrolyte 18 for smelting from a feed system 30. The alumina ($Al_2O_3$) is insoluble in the potassium sulphate ($K_2SO_4$) electrolyte, e.g., the solubility is less than one percent. A return 32 recycles a depleted flow 34 of mostly potassium sulfate ($K_2SO_4$) to the feed system 30 and keeps the electrolyte 18 at a constant level.

In another embodiment, the feed system 30 supplies $Al_2(SO_4)_3$ to the cell vessel 12.

Other electrolytes suitable for use as the electrolyte 18 are reported by T. R. Beck, supra, that are eutectic at 750° C. and that support alumina in fine-particle suspension, e.g., the eutectic $NaF-AlF_3$ and $NaF-KF-LiF-AlF_3$ mixtures. The feed system 30 is used in such a case to supply alumina particles with mean sizes of six to eight microns with no particles over ten microns. Such alumina material is commercially available from Solv-Ex Corporation (Albuquerque, N. Mex.). The sludge problem reported by the prior art is thus overcome by the fine particle alumina when used in the system 10.

A direct current power source 36 is connected with its negative terminal to the cathode 14 and its positive terminal to the anode 16. A voltage of four volts is maintained across a "gap" distance between the cathode 14 and the anode 16 to support the electrolysis of a liquid flow through a pipe 38 of a molten aluminum 40 out of the electrolyte.

In alternative embodiments, several anodes and cathodes may be arranged in series in the same cell vessel 12, although care must be taken in the construction, such that the cathodes are not all shorted together by the molten aluminum 40.

The channel 20 and the porous cathode 14 itself, are positioned deep enough, at a "depth" distance within the electrolyte 18, that a pressure head of electrolyte is provided to overcome a difference in density between the liquid aluminum and the electrolyte. Molten aluminum 40 flows out of the channel 20 through the pipe 38 of the side of the cell vessel 12. At the expected operating temperatures, the molten aluminum 40 has a density of about 2.36 grams per Cubic centimeter ($g/cm^3$) and the electrolyte 18 has a density of about 2.26 $g/cm^3$. A starter electrode comprised of a plate of aluminum is placed within the channel 20 and connected to the threaded wire 22 or another electrical conductor such as graphite. Such a starter electrode will melt away and be replaced by the molten aluminum 40 the first time the porous cathode 14 is placed in operation.

The intrusion of electrolyte 18 into the porous cathode 14, and especially the channel 20, is controlled, in part, by the molten metal filtering characteristics of the foam material of the porous cathode itself. The intrusion can also be controlled by feeding in alumina to the cell vessel 12 at a fast enough rate, and/or by a continuos adjustment of the depth of the porous cathode 14 in the electrolyte 18.

The porous cathode 14 preferably comprises a foam of open-cell porous ceramic material which includes zirconia and alumina formed as a molten metal filter and that has a fine-grain reticuled matrix with uniformly-sized pores connected to each other through openings in their walls about half the size of said pores. Such material is available from AstroMet, Inc. (Cincinnati, Ohio), as "AmPorOx", which is marketed as a molten metal filter. Standard pore sizes are ten pores-per-inch (ppi), fifteen ppi, twenty ppi and thirty ppi. Other sizes are commercially available from 5–100 ppi. Such material has an open porosity of 85%–95% of theoretical and a density of 5%–15% of theoretical. Bonded-particle filters for aluminum are also marketed by Metaullics Systems Co. LP (Solon, Ohio). Such filters are made of phosphate-bonded alumina or zircon with 20–50 ppi, or bonded granular ceramic media fabricated from aluminum oxide or silicon carbide, and conventionally filter out alumina solids from molten aluminum. Selee Corporation (Hendersonville, N.C.) also markets ceramic foam filters.

The benefits of agitating the electrolyte 18 to keep the alumina in suspension may be realized by piping input 26 to well up around the bottoms of the cathodes and anodes, and/or by adding another anode that covers the bottom of the cell vessel 12 so that oxygen bubbles from it and its positive charge repeals any aluminum ions.

Figure 2:
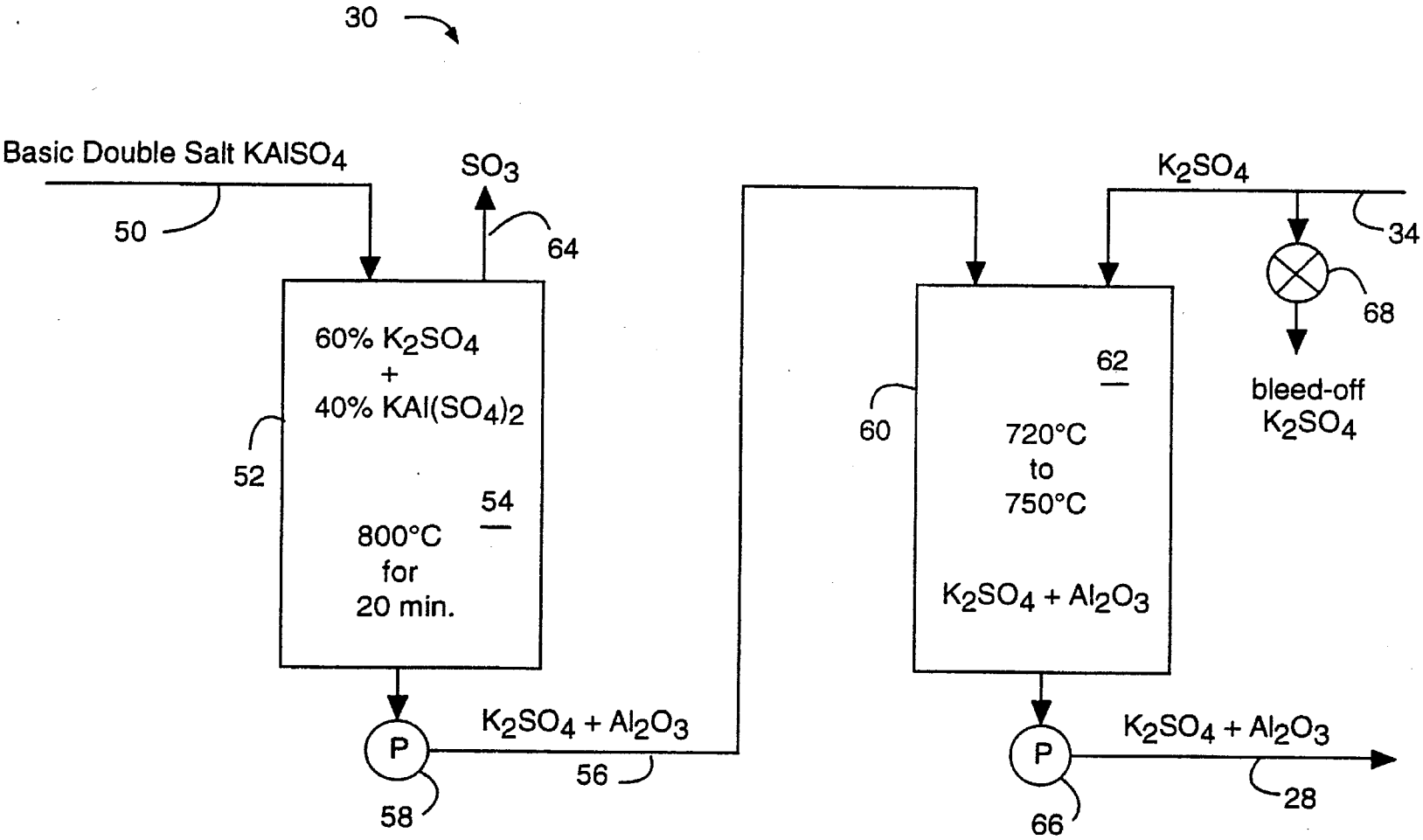
FIG. 2 is a block diagram of a feed system for the smelting system of FIG. 1.

FIG. 2 illustrates the feed system 30 which comprises a feedstock inflow 50 of a basic double salt $KAlSO_4$, a pot 52 with an electrolyte 54. The basic double salt $KAlSO_4$ has 70% less potassium and 70% less $SO_4$ than other conventional feedstocks, e.g., $KAl(SO_4)_2$ and $Al(SO_4)_3$. There are several different molten salts with eutectic properties that can be used to constitute the electrolyte 54, one is about 60% $K_2SO_4$ with about 40% $KAl(SO_4)_2$ that is molten at 590° C. The pot 52 cooks the inflow 50 with the electrolyte 54 at 800° C. for about twenty minutes and produces therefrom an electrolyte of $K_2SO_4$ with $Al_2O_3$ in fine suspension, e.g., particles with a mean size of six to eight microns with none over ten microns. A flow 56 of the electrolyte of $K_2SO_4$ with $Al_2O_3$ is pumped by a pump 58 to a pot 60 that stores a quantity 62 of the electrolyte of $K_2SO_4$ with $Al_2O_3$. A gas 64 of $SO_3$ is given off by the pot 52. The return flow 34 from the cell vessel 12 (FIG. 1) returns mostly $K_2SO_4$ with a little non-reacted $Al_2O_3$. The flow 56 increases the levels of $Al_2O_3$ and sends this to the cell vessel 12 in the mixture 28 with a pump 66. Since the $K_2SO_4$ in the mixture 28 being pumped to the cell vessel 12 is not being drawn off in the reactions within the cell vessel 12, a build-up occurs that must be bled-off periodically by a valve 68.

Figure 3:
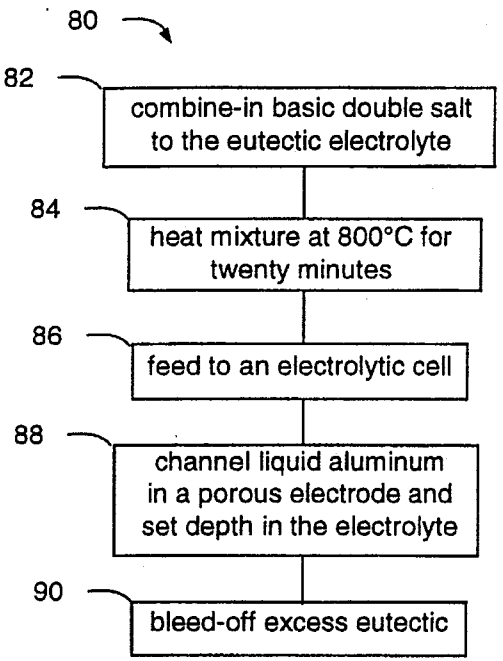
FIG. 3 is a flowchart of a method embodiment of the present invention that includes the use of the apparatus shown in FIGS. 1 and 2.

FIG. 3 illustrates a method 80 for smelting aluminum by electrolysis in a cell which comprises a step 82 for combining into a mixture, a basic double salt of $KAlSO_4$ with a first eutectic electrolyte that is molten at 590° C. A step 84 heats the mixture at 800° C. for twenty minutes to produce an out-gas of $SO_3$ and a liquid second electrolyte of $K_2SO_4$ with fine-particles of $Al_2O_3$ in suspension having a mean size of six to eight microns. A step 86 feeds the second electrolyte of $K_2SO_4$ with the $Al_2O_3$ to a cell with an anode and a porous cathode of open-cell ceramic foam material and that is maintained at 660° C. with four volts of electricity applied between the anode and the cathode, wherein oxygen bubbles at the anode and liquid aluminum forms in the porous cathode. A step 88 channels the liquid aluminum within the porous cathode, and sets the porous cathode itself, deep enough within the cell electrolyte so that a pressure head of electrolyte is provided to overcome a difference in density between the liquid aluminum and the electrolyte to pump molten aluminum from the channel out of the side of the cell. A step 90 periodically bleeds-off the electrolyte $K_2SO_4$ to control a build-up of material as aluminum is produced from the double salt of $KAlSO_4$.

Figure 4:
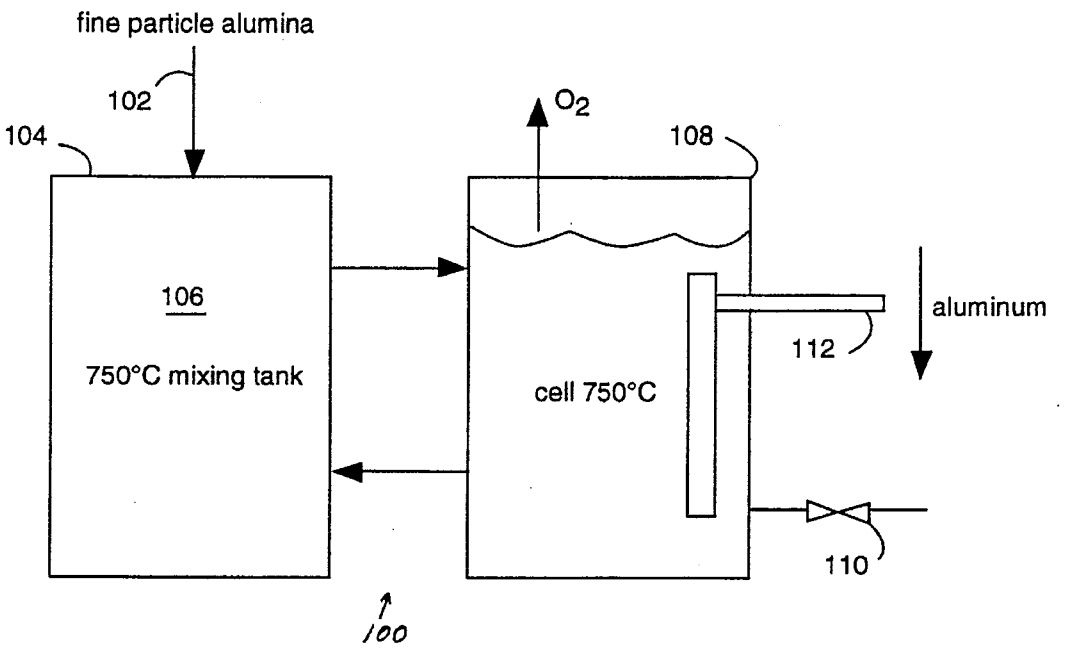
FIG. 4 is a block diagram of a feed system for directly using a sulphate eutectic or fluoride eutectic electrolyte at 750° C. with fine alumina.

FIG. 4 illustrates a preferred embodiment of the present invention, a system 100, which adds a flow 102 of fine particles of alumina into a mixing vessel 104 with an electrolyte 106 comprising a eutectic sulphate salt or a eutectic fluoride salt at 750° C. Such a slurry is then fed to an electrolytic cell 108 for reduction to aluminum. A spigot 110 allows for periodic rework of the sludge which forms in the bottom and a flow of aluminum comes out the side of the cell 108.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A system for smelting aluminum by electrolysis, comprising:

a vessel for containing a liquid;

an electrolyte bath of a molten eutectic salt adapted to be contained by the vessel and having a specific gravity; and a porous cathode comprised of open-cell porous non-electrically conductive material with an electrical conductor threaded through said material and a channel within said material for conducting away a molten-aluminum flow, wherein an anode is adapted for immersion in the bath to a depth which provides for the electrolyte bath to pressurize a flow of said molten-aluminum out of the cell through said channel.

2. The system of claim 1, wherein:

the electrolyte bath comprises a feed of alumina ($Al_2O_3$) in fine-particle suspension in one of the eutectic mixtures of $NaF-AlF_3$ and $NaF-KF-LiF-AlF_3$.

3. The system of claim 1, further comprising:

heating means for maintaining the temperature of the electrolyte bath above the melting point of aluminum.

4. The system of claim 1, wherein:

the porous cathode comprises a foam of opencell porous ceramic material.

5. The system of claim 4, wherein:

said ceramic material includes zirconia and alumina formed as a molten-metal filter which has a fine-grain reticuled matrix with uniformly-sized pores connected to each other through openings in their walls about half the size of said pores.

6. The system of claim 1, wherein:

the porous cathode is filled with molten aluminum precipitate from the electrolytic bath and is electrically connected to said threaded conductor.

7. The system of claim 1, wherein:

said threaded conductor in the porous cathode comprises a metal wire.

8. The system of claim 1, wherein:

the electrolyte bath comprises a eutectic mixture of potassium aluminum sulphate ($KAl(SO_4)_3$) and potassium sulfate ($K_2SO_4$) with fine-grain alumina ($Al_2O_3$) in suspension having mean particle sizes in the range of six to eight microns.

9. The system of claim 8, further comprising:

feed system means for cooking a basic double salt of $KAl(SO_4)_2$ added to said eutectic mixture with a heating means at approximately 800° C. to produce said fine-grain alumina ($Al_2O_3$) in suspension having mean particle sizes in the range of six to eight microns.

10. The system of claim 1, further comprising:

input means for providing an alumina feed stock of mean-sized particles in the range of six to eight microns.

11. A method of smelting aluminum by electrolysis in a cell comprises:

combining into a mixture, a basic double salt of $KAlSO_4$ with a first eutectic electrolyte that is molten at 590° C.;

heating said mixture at 800° C. for twenty minutes to produce an out-gas of $SO_3$ and a liquid second electrolyte of $K_2SO_4$ with fine-particles of $Al_2O_3$ in suspension having a mean size of six to eight microns;

feeding said second electrolyte of $K_2SO_4$ with said $Al_2O_3$ to a cell with an anode and a porous cathode of open-cell ceramic foam material and that is maintained at 660° C. with four volts of electricity applied between said anode and said cathode, wherein oxygen bubbles at said anode and liquid aluminum forms in said porous cathode; and channeling said liquid aluminum within the porous cathode, and setting said porous cathode itself, deep enough within said cell electrolyte that a pressure head of electrolyte is provided to overcome a difference in density between said liquid aluminum and said electrolyte to pump molten aluminum from said channel out of the side of said cell.

12. The method of claim 11, further comprising the step of:

periodically bleeding-off said electrolyte $K_2SO_4$ to control a build-up of material as aluminum is produced from said basic double salt of $KAlSO_4$.

13. A porous electrode for the smelting of metal by electrolysis, comprising:

an open-cell foam material (14) for immersion in an electrolyte (18) said foam material having a completely enveloped hollow interior space (20);

a channel (38) connected to said, hollow interior space (20) for conducting away a molten metal removed from said electrolyte by electrolysis which flows through the open-cell foam material into said interior hollow space; and an electrical contact (22) disposed within the open-cell foam material for establishing an electrical connection to an external power source for electrolysis of said molten metal.

14. The porous electrode of claim 13, wherein:

the channel is positioned at a depth within said electrolyte that provides for a pressure head of electrolyte to force out a flow of said molten metal, wherein said molten metal has a higher material density than that of said electrolyte.

15. The porous electrode of claim 13, wherein:

the porous cathode comprises a foam of open-cell porous ceramic material formed as a molten-metal filter with a fine-grain reticuled matrix of uniformly-sized pores connected to each other through openings in their walls about half the size of said pores.

* * * * *